United States Patent [19]

Hammersburg

[11] 4,073,537

[45] Feb. 14, 1978

[54] UNIVERSAL SUPPORT PADS FOR WHEELCHAIR

[76] Inventor: Don D. Hammersburg, 3516 NE. 119th Ave., Vancouver, Wash. 98662

[21] Appl. No.: 725,692

[22] Filed: Sept. 23, 1976

[51] Int. Cl.[2] ..... A62B 35/00

[52] U.S. Cl. ..... 297/384; 297/DIG. 4

[58] Field of Search ..... 297/384, 411, DIG. 4, 297/427; 128/227; 280/644; 248/279, 287, 288, 289; 269/322, 328

[56] References Cited

U.S. PATENT DOCUMENTS

| | | | |
|---|---|---|---|
| 527,056 | 10/1894 | Gilson | 297/411 |
| 1,516,795 | 11/1924 | Schwarting | 269/328 |
| 1,527,754 | 2/1925 | Simon | 297/411 X |
| 1,625,682 | 4/1927 | Ragg | 269/328 |
| 2,614,558 | 10/1952 | Lovell | 269/328 X |
| 3,140,119 | 7/1964 | Offner | 297/422 X |
| 3,640,571 | 2/1972 | Keropian | 297/DIG. 4 |
| 3,761,126 | 9/1973 | Mulholland | 297/411 X |

*Primary Examiner*—James T. McCall
*Attorney, Agent, or Firm*—Kolisch, Hartwell, Dickinson & Stuart

[57] ABSTRACT

A device for positioning a patient in a chair having a back and arms. The device includes a pad for placement against the patient and a clamp which underlies an arm of the chair and is shiftable along the length of the arm independently of the back. The pad is connected to the clamp by a series of connecting members which permit universal swinging of the pad about a plurality of angularly disposed and laterally spaced axes. The pad also is mounted for shifting laterally of the attaching clamp and the arm to which it is attached and for shifting vertically and horizontally forwardly and rearwardly relative to the chair. Locking mechanism is provided for securing the pad in any of the infinitely selectable positions for the pad to maintain patient positioning within the chair. A similar pad attached to the opposing arm on the chair also may be used to aid in patient positioning.

14 Claims, 9 Drawing Figures

FIG.4
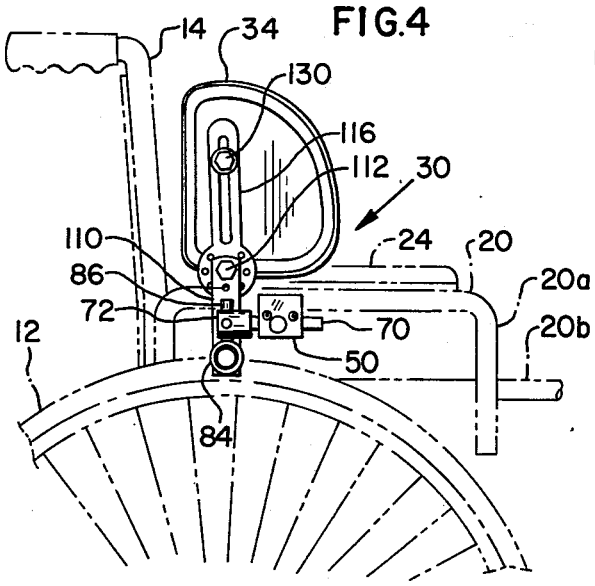
FIG. 5
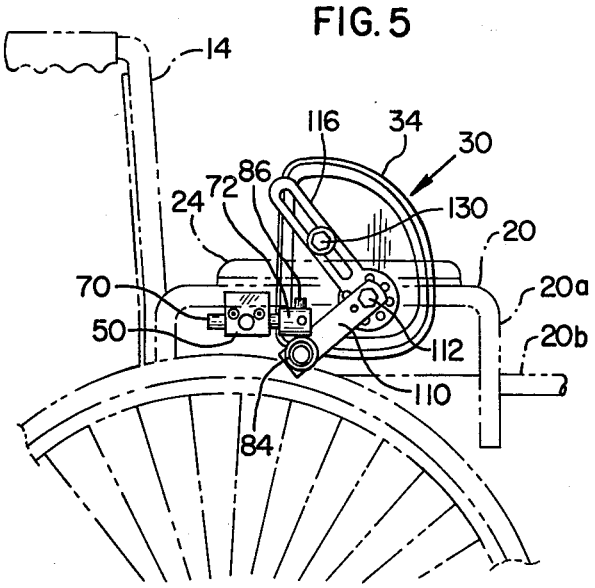
FIG.6
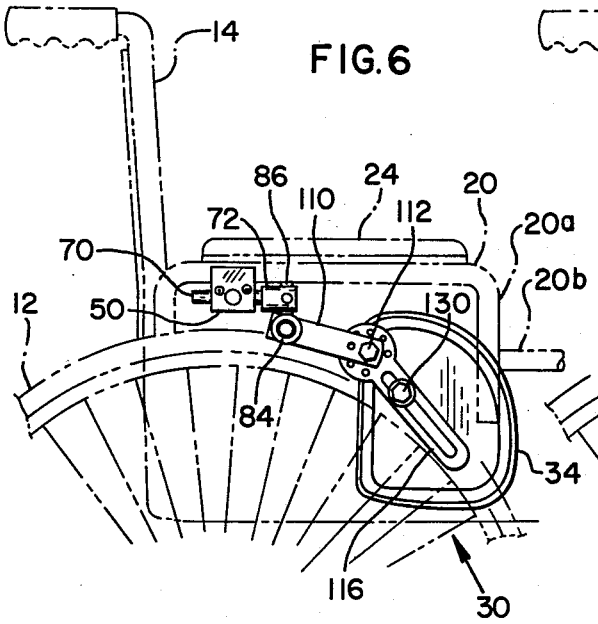
FIG. 7
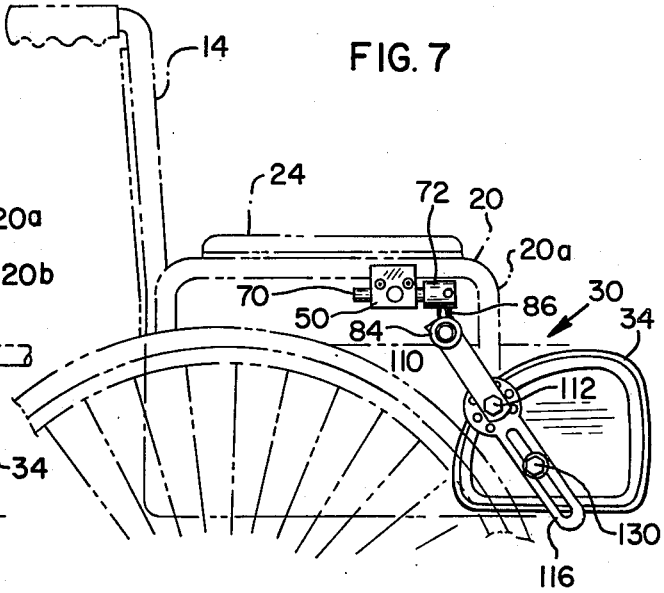
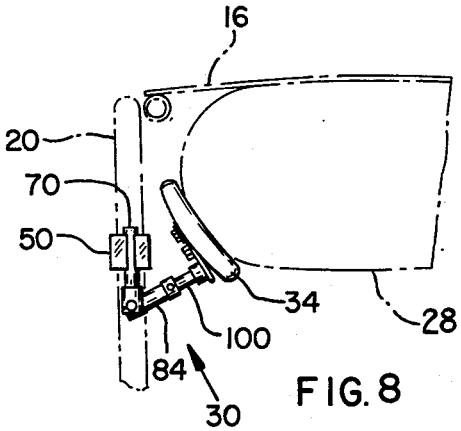
FIG. 8
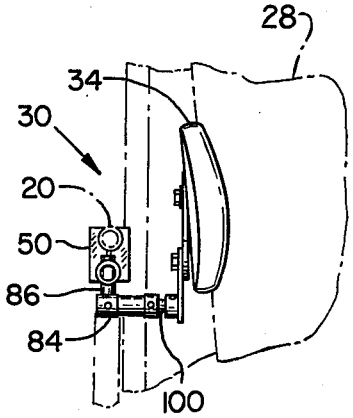
FIG. 9

UNIVERSAL SUPPORT PADS FOR WHEELCHAIR

BACKGROUND AND SUMMARY OF THE INVENTION

This invention relates to a universally adjustable pad for positioning a patient in a chair.

The need for a device to position a patient within a chair, such as in a wheelchair, is becoming increasingly important. Medical and equipment technology now enables more patients to utilize wheelchairs rather than being bedridden.

Increased emphasis recently has been placed on the potential of independent, or self-help, activities of those confined to wheelchairs due to physical or mental impairments or deficiencies. Increased function of the patient's body is essential, and to this end it is often desirable to be able to provide a form of support either of the thigh, hip, or torso to permit the patient to be most comfortable or to function to the greatest degree in an effort and with his own ability to attempt to provide some form of care and movement for himself.

The patient may be handicapped or have a deficiency which prevents him from maintaining full control over his bodily movements due to loss of motor control, lack of muscle tone, slow response to correct inaccurate actuation of muscular activity, congenital or birth defects, or abnormal growth structure. Positioning of such individuals in a seated position to allow them to function most efficiently with their handicap or disability may require limiting or restricting the movement of the thigh, hip or torso, either bilaterally or unilaterally.

A general object of the present invention is to provide a novel device for positioning a patient in a chair which is simply and economically constructed to produce the desired results set out above.

More specifically, an object of the invention is to provide a novel positioning device which is shiftable to selected, adjusted positions to provide positioning control in the areas of the hip, thigh, or torso of the patient and which is mounted on the arm of the chair for selected movement longitudinally of the arm to provide the widest possible range of positioning for the support pad in the device to reach and provide support for all such regions of a patient's body.

A still further object of the present invention is to provide such a novel positioning device which includes a body engaging pad, an attaching clamp for securing the same to the underside of the arm of the chair, and connecting means connecting the pad to the attaching clamp which is operable to provide universal swinging movement of the pad about a plurality of angularly disposed axes, yet which does not structurally protrude to a significant degree beyond the overall limits of the chair, whereby it does not interfere with movement of the patient's arms and self propulsion of the chair through manual operation of the chair wheels.

A further object of the present invention is to provide such a novel positioning device which may be attached to a detachable arm on a wheelchair, secured in a selected position relative to the arm for supporting a patient in a chair, and upon removal of the arm, travels with the arm to permit ease of entrance and exit from the chair without varying adjustment settings on the pad relative to the arm of the chair.

Yet another object of the present invention is to provide such a novel positioning device which permits a wheelchair to be folded as intended by the manufacturer regardless of the location of the device without moving it from its selected adjusted position.

DRAWINGS

These and other objects and advantages will become more fully apparent as the following description is read in conjunction with the drawings wherein:

FIGS. 4–7 are side elevation views of a portion of the chair illustrating various adjusted positions to which a support pad of the invention may be adjusted;

FIG. 8 is a cross-sectional view taken generally along the line 8—8 in FIG. 1; illustrating in top plan view a selected adjusted position for the pad; and FIG. 9 is a view taken along the line 9—9 in FIG. 1 illustrating a front elevational view of the pad in a selected adjusted position.

DETAILED DESCRIPTION OF A PREFERRED EMBODIMENT OF THE INVENTION

Figure 1:
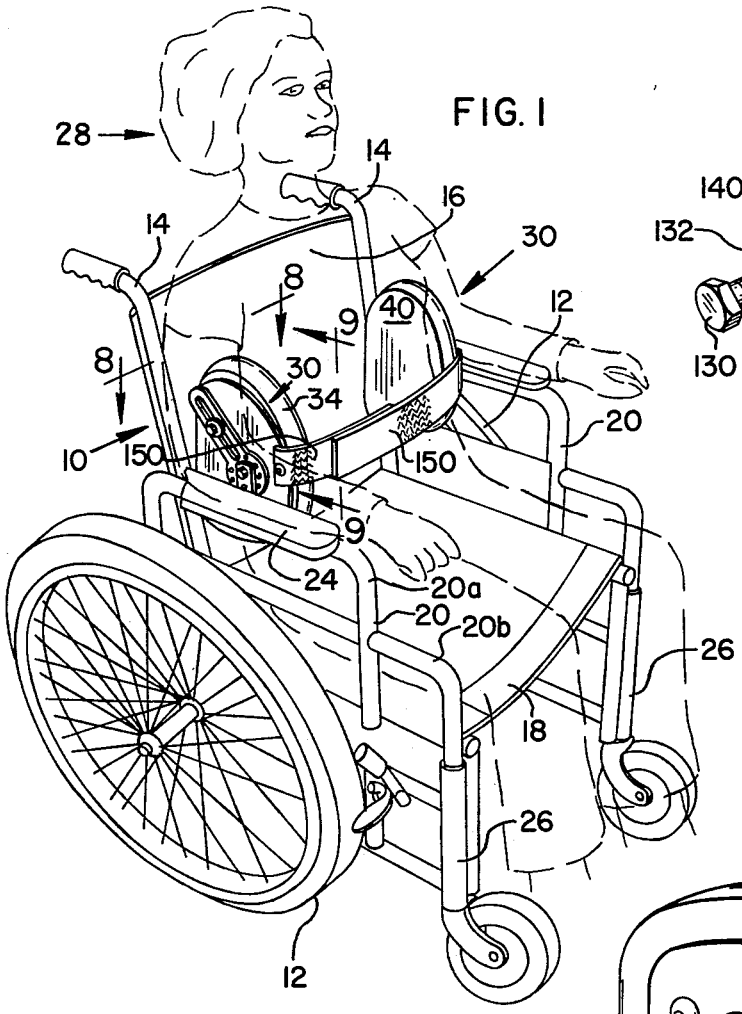
FIG. 1 is a perspective view of a wheelchair having positioning devices constructed according to an embodiment of the invention mounted thereon and illustrating a patient positioned in the chair, with the patient illustrated in dot-dash-dot line.

Referring to FIG. 1 a wheelchair 10 is illustrated having a pair of laterally spaced, manually operable support wheels 12 and a pair of upstanding, laterally spaced support bars 14 supporting a flexible back 16 for the chair.

A pair of elongate chair arms 20 are supported intermediate wheels 12 and extend forwardly from back support bars 14. Each arm comprises a tubular member **20*a* bent in an inverted U-shape and an inverted L-shaped tubular member 20*b* secured adjacent one of its ends to and projecting forwardly from one leg of member 20*a*. The upper, substantially horizontally disposed crossbar portion of member 20*a* has an elongate arm pad 24** secured thereto.

The chair frame includes upright support tubes 26 adjacent its forward and rearward corners which telescopically receive a downwardly depending leg of tubular member **20*a* and the downwardly depending leg of tubular member 20*b*. This permits both chair arms to be removably supported on the chair. As illustrated in FIG. 1, the arms are supported on opposite sides of a flexible seat panel 18, and each arm may be removed by lifting it out of support tubes 26**. This provides greater access and ease of entry or exit for a patient in the chair.

A patient is illustrated in dot-dash-dot line at 28 in FIG. 1.

A pair of devices according to the invention for positioning a patient in the chair are indicated generally at 30. Both of devices 30 are similar, and thus only one will be described in detail.

Figure 2:
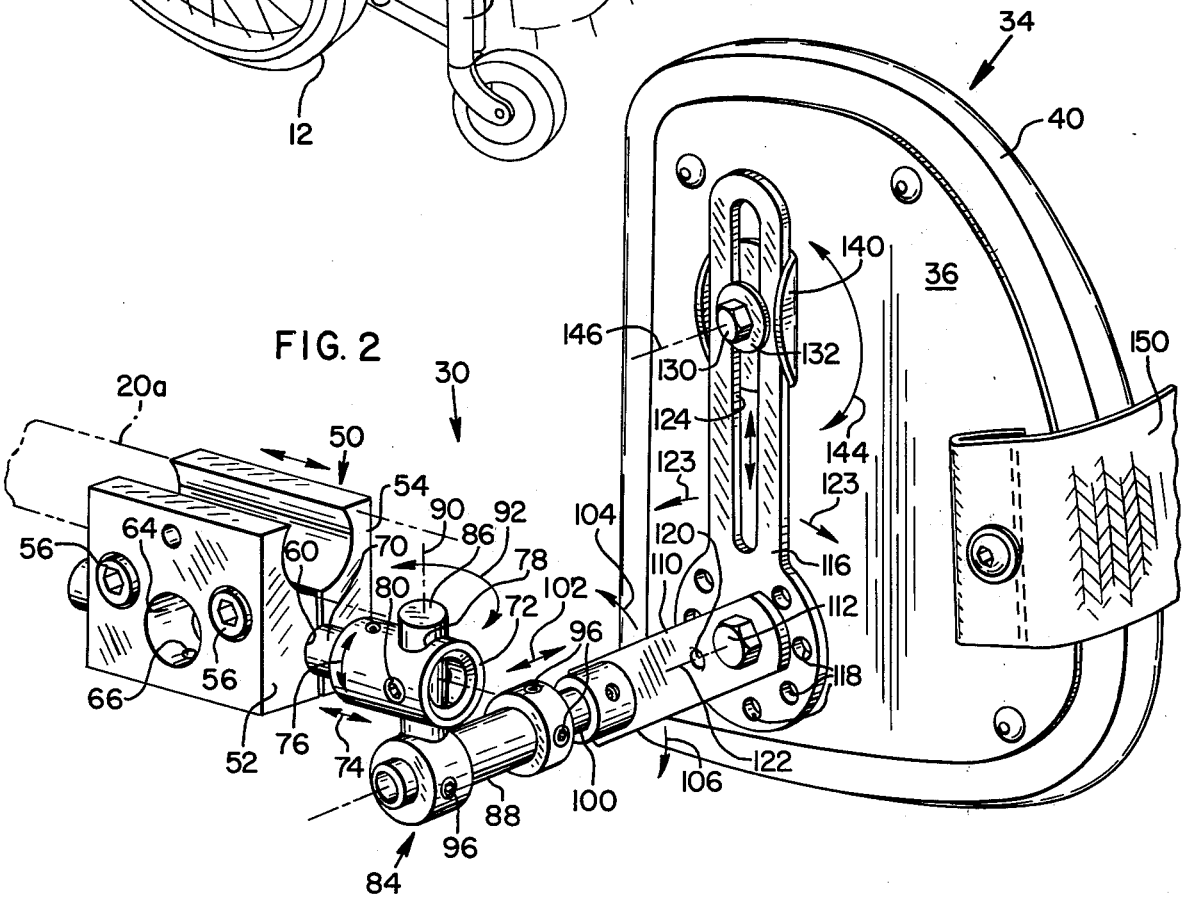
FIG. 2 is an enlarged perspective view of a positioning device.

Referring to FIG. 2, a positioning device includes a body engaging pad 34. The pad is oblong as illustrated, and includes a substantially rigid backing plate 36. To the inwardly facing side (the side away from the viewer in FIG. 2) of plate 36 is secured a resilient flexible material, such as foam rubber, which is covered by a flexible material, such as vinyl cover 40.

Figure 3:
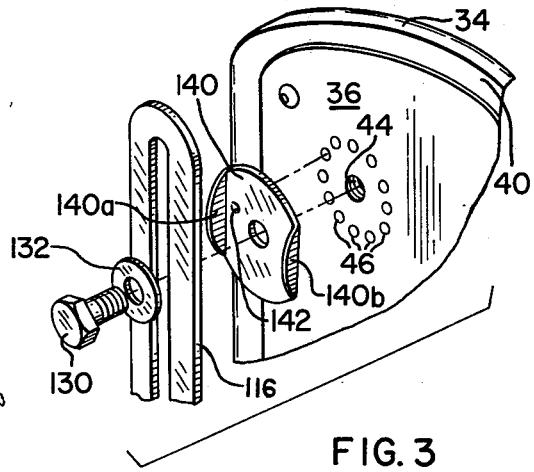
FIG. 3 is an enlarged exploded, perspective view of means for attaching an adjustment member to a patient support pad in the device.

Referring to FIG. 3, backing plate 36 has a threaded bore 44 formed therein which is positioned more closely to one edge, or end, of the pad than to the opposite end, or edge. A plurality of depressions, or holes, 46 are arrayed in a circle about bore 44 equadistant from the center of bore 44.

Referring again to FIG. 2, an attachment clamp 50 is provided for attaching the device to the underside of the horizontally disposed cross bar portion of tubular member 20*a*, illustrated in dot-dash-dot line in FIG. 2. Clamp 50 includes a pair of opposed, mirror image clamp block sections 52, 54. Each block section has a semi-circular groove formed therein, which when the blocks are placed in facing relationship as illustrated, define a semi-circular groove to clamp about tube member 20*a* beneath arm pad 24. A pair of set screws 56 extend through accommodating bores in clamp box sections 52, 54. The bores in block section 54 are threaded and tightening of the screws secures the clamp member in position on the arm of the chair.

A second pair of semi-circular grooves extend along facing surfaces of blocks 52, 54 to define a rod receiving bore 60 therebetween. This bore extends parallel to the previously mentioned grooves in blocks 52, 54 and thus extends parallel to the arm of the chair when the clamp is attached. A secondary bore 64 extends through blocks 52, 54 perpendicular to bore 60. A threaded bore 66 extends through the underside of block section 52 and into bore 64 to receive a set screw.

An elongate rod 70 is received in bore 60 between block sections 52, 54. A cylindrical member 72 is secured to the end of rod 70 which projects from bore 60. This rod and cylinder combination are referred to herein as a first member. With screws 56 loosened, this first member is shiftable longitudinally of rod 70, and thus longitudinally of the arm of the chair as illustrated by arrow 74. It is also rotatable about the longitudinal axis of rod 70 as illustrated by doubleheaded arrow 76.

Referring still to FIG. 2, cylindrical portion 72 has a bore 78 extending therethrough normal to the longitudinal axis of rod 70 and cylinder 72. A set screw 80 extends inwardly through a threaded bore in the side of cylinder 72.

A second member indicated generally at 84 includes an elongate rod 86 to the lower end of which is secured an elongate, hollow cylindrical element 88. Cylinder 88 is secured adjacent one of its ends to rod 86 and extends substantially normally outwardly from rod 86. With set screw 80 loosened, rod 86 and cylinder 88 are rotatable in either of opposite directions about an axis 90 as illustrated by doubleheaded arrow 92. In the position illustrated, axis 90 extends substantially vertically and intersects the cross bar portion of arm 20*a*.

Thus, member 84 may be rotated between a first position as illustrated in FIG. 2, in which the major portion of cylinder 88 extends inwardly of the chair in the direction of the face of the arm facing a patient, and a second position directed 180° therefrom with the major portion of cylinder 88 directed outwardly and away from the patient.

As is seen in FIG. 2, a plurality of set screws 96 are received in threaded bores adjacent opposite ends of cylinder 88.

An elongate, tubular shaft 100, also referred to as a third member herein, extends through the central bore of cylinder 88. With set screws 96 loosened, shaft 100 is shiftable longitudinally of its central axis relative to cylinder 88, in the directions of doubleheaded arrow 102, and is rotatable about its longitudinal axis in the directions of arrows 104, 106. With set screws 96 tightened, shaft 100 is secured against movement relative to cylinder 88.

Secured to and extending laterally outwardly from one end of shaft 100 is an elongate flat bar 110, also referred to as a fourth member herein. The bar has a bore extending through its end spaced from shaft 100 which receives a bolt 112 therethrough.

An elongate slide member 116 has a threaded bore adjacent one of its ends which receives bolt 112 whereby slide 116 may be secured to bar 110. A plurality of depressions, or holes, 118 are arrayed about the bore receiving bolt 112 and are substantially equadistant therefrom. A dimple, or detent, 120 formed in bar 110 is positioned to project into a hole 18 to secure the slide member 116 against rotation relative to bar 110 when bolt 112 is tightened. When bolt 112 is loosened slide member 116 is swingable about a pivot axis 122 extending longitudinally of bolt 112 in the direction of arrows 123.

Slide member 116 also has an elongate slot 124 formed therein extending longitudinally of the slide member.

A bolt 130 having a washer 132 thereunder extends through slot 124 into threaded bore 44 in backing plate 36 of the pad to secure the pad to slide member 116. Referring to FIG. 3, a holding washer 140 having edge or wing, portions 140*a*, 140*b* bent outwardly substantially normal to the central portion of washer 140 is received between slide member 116 and backing plate 36. Wing portions 140*a*, 140*b* of washer 140 are spaced apart a distance slightly greater than the width of slide member 116. A dimple, or detent, 142 formed in washer 140 is positioned to be received in one of holes 46. Thus, when bolt 130 is loosened, pad 34 may be swung in opposite directions as illustrated by arrow 144 about axis 146 extending axially of bolt 130. With bolt 130 loosened the pad also is slidable along slot 124 relative to the slide member. When the pad is positioned as desired on the slide member and in an angular position relative to the slide member, tightening of bolt 130 causes washer 132 frictionally to engage slide member 116 to prevent sliding movement of the pad therealong, and detent 142 is received in one of depressions 46 in the backing plate to inhibit rotation of the pad relative to the slide member.

The connector means thus described for operatively connecting patient engaging pad 34 to clamping attachment 50 provides for universal movement of the pad relative to the chair for selected adjustment relative to a patient in the chair. The various degrees of movement of the pad relative to the chair provided by such connector means should be evident from the description of the connections, but such will be described in greater detail below in a description of the operation of the device.

Referring again to FIG. 1, it will be seen that a pair of straps, or belts, 150 are secured at one set of their ends to the pads. The straps may have fastening means, such as velcro strips, adjacent their opposite set of ends to secure them together, as illustrated in FIG. 1, across the body of the patient if it is desired to so secure the patient in the chair.

Describing operation of the device, it should be evident that the support pad is movable to several different positions relative to the arm of the chair, and by being secured to an arm of the chair, is removable therewith. Describing briefly the various degrees of movement of the pad, upon loosening of said screws 56 of the clamp attachment may be slid longitudinally of the horizontal cross bar portion of the chair arm between positions as illustrated in FIGS. 4, 5, 6 and 7. The clamp attachment thus may be shifted forwardly or rearwardly along the arm of the chair, and toward and away from the back of the chair. Rod 70 may be shifted longitudinally relative to the clamp block sections and may be rotated relative thereto.

With set screw 80 loosened, cylinder 88 may be rotated about upright axis 90 as desired. With set screws 96 loosened, shaft 100 is shiftable longitudinally of cylinder 88 and is rotatable therein. With bolt 112 loosened, slide member 116 is rotatable about pivot axis 122 relative to bar 110. With bolt 130 loosened, pad 34 is slidable along slide member 116 and is rotatable about pivot axis 146 relative to the slide member.

It should be mentioned here that cylinder 88 is purposefully secured adjacent one of its ends to rod 86 so that the major portion of cylinder 88 may be swung either toward the inwardly facing side or the outwardly facing side of the chair arm. With the cylinder swung toward the inwardly facing side of the chair arm, maximum lateral extension of shaft 100 inwardly of the chair arm is permitted. With the cylinder 88 swung to a position extended toward the outwardly facing side of the chair arm, shaft 100 and the pad secured thereto may be slid closest to the chair arm. In this way maximum latitude of shifting of the pad laterally of the chair arm is provided without requiring an excess of shaft protruding beyond the outer side of the chair arm which has occurred in previous devices and which would impede arm movement in controlling the chair and other activities.

To provide support for the torso of the body, it is a simple matter to adjust the pad to the position illustrated generally in either FIGS. 1, 2 and 4 whereby the pad extends upwardly from the arm of the chair and can be shifted laterally inwardly against the side of the patient. As is illustrated in FIGS. 8 and 9, which are top and front views respectively of the pad, the various degrees of rotation permitted by the connector devices permit the pad to engage the torso at any desired angle to provide support and comfort to the patient. Lower torso support may be provided by shifting the pad to the position illustrated in FIG. 5. Hip support may be provided by positioning as illustrated in FIG. 6. Positioning as illustrated in FIG. 7 permits support of the thigh portion of the leg of the patient.

After the pad has been positioned as desired, it is a simple matter to tighten the various set screws and bolts therein to secure the various connector members and pad into position whereby the pad will remain locked in that position relative to the arm.

A device as described has many advantageous features. First, by being attached to the underside of the arm as described and by having minimal chance of parts protruding into the way of the arms or hands of the patient, it will provide desired support for the patient without impeding use of the patient's hands or arms. By being shiftable longitudinally along the arm of the chair, maximum range of positioning is obtained for use on either torso, hips, or thighs of the patient. By permitting movement of the clamping device along the arm it permits the pad to be positioned as necessary to provide either frontal support as illustrated in FIG. 8, or side support as illustrated in FIG. 1. The various locking features of the device allow it to be secured in position and remain there throughout use.

While a preferred embodiment of the invention has been described herein, it should be apparent to those skilled in the art that variations and modifications are possible without departing from the spirit of the invention.

What is claimed is:

1. A device for positioning a patient in a chair having a back and arms, said device comprising body engaging pad means, attaching means for attachment to the underside of an arm of the chair and for movement along said arm toward and away from the chair back, means for securing said attaching means in a selected position on said chair arm, connecting means operatively connecting said pad to said attaching means accommodating universal movement of the pad relative to said attaching means to place said pad in a selected position relative to said chair for patient positioning, and securing means for securing said pad in a selected adjusted position.

2. The device of claim 1, wherein said attaching means comprises a clamp slidably mounted on said chair arm and said means for securing said attaching means comprises means for clamping said clamp to said arm to frictionally hold the same against movement along said arm.

3. The device of claim 1, wherein said connecting means comprises a first member mounted on said attaching means for rotation about a substantially horizontal axis extending substantially parallel to and underlying said arm, a second member connected to said first member and underlying said arm for rotation about a substantially upright axis, and a third member underlying said arm and connected to said second member for rotation about a substantially horizontal axis extending transversely of said arm.

4. The device of claim 3, wherein said third member comprises an elongate, substantially horizontally disposed element slidably connected to said second member for selected extension and retraction relative to said second member in a direction extending laterally of said arm.

5. The device of claim 4, which further comprises an elongate fourth member connected adjacent one of its ends to an end portion of said third member and extending outwardly therefrom at a substantial angle relative to the rotational axis for said third member and being swingable about said rotational axis.

6. The device of claim 5, which further comprises an elongate slide member, means pivotally connecting said slide member to said fourth member adjacent a set of ends of said fourth member and said slide member, and means connecting said pad means to said slide member permitting sliding movement of said pad means longitudinally of said slide member and swinging of said pad means relative to said slide member about an axis extending transversely of said slide member.

7. The device of claim 5, wherein said means connecting said pad means to said slide member is spaced more closely to one edge of said pad means than to other edges thereof.

8. The device of claim 7, wherein said securing means comprises detent means operable to produce positive locking of said pad means in a selected position.

9. The device of claim 1, wherein said attaching means comprises a clamp member attachable to the underside of an arm for movement longitudinally thereof, and said connecting means comprises means connected to said clamp member underlying said arm and supporting said pad means for swinging about a first axis which extends substantially horizontally beneath and substantially parallel to said arm, a second axis extending substantially vertically and intercepting said arm, and a third axis extending substantially horizontally beneath said arm and transversely of said arm.

10. The device of claim 9, wherein said connecting means further comprises means mounting said pad means for swinging about a fourth axis which extends substantially horizontally and transversely of said arm and is spaced from said third axis.

11. The device of claim 10, wherein said connecting means further comprises means mounting said pad means for rotation about a fifth axis extending substantially horizontally and transversely of said arm, with said fifth axis being spaced from said third and fourth axes.

12. The device of claim 11, wherein said connecting means further comprises an elongate slide member on which said pad means is slidably mounted accommodating adjustment of the distance between said fourth and fifth pivot axes.

13. The device of claim 12, wherein said fifth axis is spaced from the center of said pad means.

14. A device for positioning a patient in a chair having a back and arms wherein an arm has an inner side facing generally in the direction of a patient and an outer side facing away from the patient receiving region, said device comprising body engaging pad means, attaching means for attachment to the underside of an arm of the chair and for movement along said arm toward and away from the chair back, means for securing said attaching means in a selected position on said chair arm, connecting means operatively connecting said pad to said attaching means accommodating universal movement of the pad relative to said attaching means to place said pad in a selected position relative to said chair for patient positioning, said connecting means comprising a substantially horizontally disposed elongate tubular member pivotally connected adjacent one of its ends to said attaching means, and an elongate shaft mounted removably and slidably in said tubular member for selected longitudinal adjustment relative thereto to permit adjustment of said pad means laterally of said arm, said elongate tubular member being swingable about said upright axis to a first position in which it extends in the direction of the inner side of the arm to permit adjusting said pad means to a position furthest from said arm and a second position extending in the direction of the outer side of the arm to permit adjusting of said pad means to a position nearest to said arm with minimum structure extending beyond said outer side of the arm.

* * * * *

UNITED STATES PATENT AND TRADEMARK OFFICE

CERTIFICATE OF CORRECTION

PATENT NO. : 4,073,537
DATED : February 14, 1978
INVENTOR(S) : Don D. Hammersburg It is certified that error appears in the above-identified patent and that said Letters Patent are hereby corrected as shown below:

In column 4, line 68, delete "of" second occurrence .

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*